United States Patent [19]

Miyagishima et al.

[11] 4,294,314

[45] Oct. 13, 1981

[54] INSIDE BLOWOUT PREVENTER WELL TOOL

[75] Inventors: Tosh Miyagishima; Joseph Puntar; Raymond Wieveg, all of Los Angeles, Calif.

[73] Assignee: Hydril Company, Los Angeles, Calif.

[21] Appl. No.: 108,384

[22] Filed: Dec. 31, 1979

[51] Int. Cl.[3] ..... E21B 43/00; F16K 31/63

[52] U.S. Cl. ..... 166/318; 166/321; 137/494; 251/58

[58] Field of Search ..... 166/318, 321, 323, 324; 175/318; 137/494, 496

[56] References Cited

U.S. PATENT DOCUMENTS

| | | | |
|---|---|---|---|
| 2,162,578 | 6/1939 | Hacker | 166/323 X |
| 2,921,601 | 1/1960 | Fisher, Jr. | 175/318 X |
| 2,944,793 | 7/1960 | Conrad | 175/318 X |
| 3,318,387 | 5/1967 | Jones | 175/318 X |
| 3,788,594 | 1/1974 | Mott | 166/323 X |
| 4,154,303 | 5/1979 | Fournier | |

*Primary Examiner*—James A. Leppink
*Assistant Examiner*—Richard E. Favre
*Attorney, Agent, or Firm*—Pravel, Gambrell, Hewitt, Kirk, Kimball & Dodge

[57] ABSTRACT

An inside blowout preventer well tool includes an elongated body threaded at both ends and including an axial opening. A flapper is pivotally mounted on a side of the opening and movable between a lower-open position and an upper-closed position. A downwardly-facing valve seat is formed around the opening, the flapper engaging the seat in the upper-closed position. A spring urges the flapper toward the seat and a piston is movable in the opening between an upper position, where the lower end of the piston is above the valve seat, and a lower position, where the piston encases the flapper and holds it in the lower-open position. The piston is normally urged toward its upper position, the piston being shaped so that when the internal pressure of drilling mud normally circulating through the opening is greater by a predetermined amount than pressure outside the body, the pressure differential will overcome the force urging the piston upwardly and move the piston to the lower position. The piston is also responsive to fluid pressure outside the body so that the piston will automatically be moved to its upper position when e differential is reduced by a predetermined

Claims, 4 Drawing Figures

INSIDE BLOWOUT PREVENTER WELL TOOL

TECHNICAL FIELD

The subject invention relates to a well tool for controlling fluid flow through the bore of drilling pipe during a blowout. The subject tool is adapted to be mounted in a drill string at any point above the drill bit for controlling blowout flow whenever the drill bit penetrates a high pressure formation during operation. The tool includes a valve which automatically closes when blowout pressure eliminates the pressure differential between the well bore and the annulus surrounding the drill string caused by the pressure drop across the drill bit, so that a heavier density drilling mud can be circulated downwardly through the drill string to bring the well under control.

BACKGROUND ART

U.S. Pat. No. 3,861,470 and other related U.S. patents cited therein, all of which are owned by the same corporate entity which owns the subject invention, are directed to a blowout preventer method and apparatus which utilize a ball-shaped valve that opens and closes automatically in response to changes in pressure differential between the wellbore and the annulus between the drill string and the wall of the drill hole. When the pressure differential is lost a ball element is automatically rotated shut. After conditions return to normal a spring or other pressure exerting means operates to rotate the ball valve back to its open position.

Although this blowout preventor valve proved effective for its intended purpose, it has the disadvantage that well tools cannot be run below the valve when the ball is closed.

Further, with ball valves of the types described above the internal components inherently have a relatively small bore in the valve which causes a pressure drop across the valve and requires a higher pump pressure for effective operation.

DISCLOSURE OF INVENTION

The problems discussed above are solved in accordance of the invention by replacing the ball-type valve shown and described in the cited patents with a valve which utilizes a flapper element that is spring-loaded and normally urged shut against a downwardly-facing valve seat. A piston engages the flapper and holds it open under normal operating conditions where the pressure of circulating drilling mud in the wellbore is greater than that outside the drill string and acts upon the piston and overcomes the force of a power spring which normally urges the piston away from the flapper. In this position the flapper is encased by the piston, protecting it from the circulating mud.

When well pressure outside the tool increases, the pressure differential between the inner and outer portions of the tube will be lost causing fluid to flow from outside the tool into an expansible chamber in the tool in which the power spring is housed, the loss of the pressure differential allowing the power spring to expand in the chamber and raise the piston allowing the flapper to move upwardly against the seat and close. When the well pressure is brought under control, for example, by circulating a heavier drilling mud through the drill string, the pressure differential acting on the piston will again be able to overcome the force of the power spring and move the piston downwardly to open the flapper.

The flapper can be maintained open by inserting a sleeve in the tool in a position to engage the flapper and prevent it from closing in a manner similar to how the piston works. This can be done during installation of the tool or whenever a service or instrumentation tool needs to be run below the blowout preventor. The sleeve can be removed by a retrieval tool which can pass through the sleeve when moving downwardly, but will engage the sleeve when pulled upwardly through the drill string.

Use of such a flapper valve configuration allows the internal parts of the valve to be formed as a cartridge which can be easily inserted and installed into a body sub. This type of configuration also provides a greater diameter opening through the valve than the ball-type valves resulting in a lower pressure drop in the circulating fluid.

BRIEF DESCRIPTION OF DRAWINGS

The invention will better be understood when a detailed description of a best mode for carrying out the invention, set forth below, is considered in conjunction with the accompanying drawings, in which.

BEST MODE FOR CARRYING OUT THE INVENTION

Figure 1:
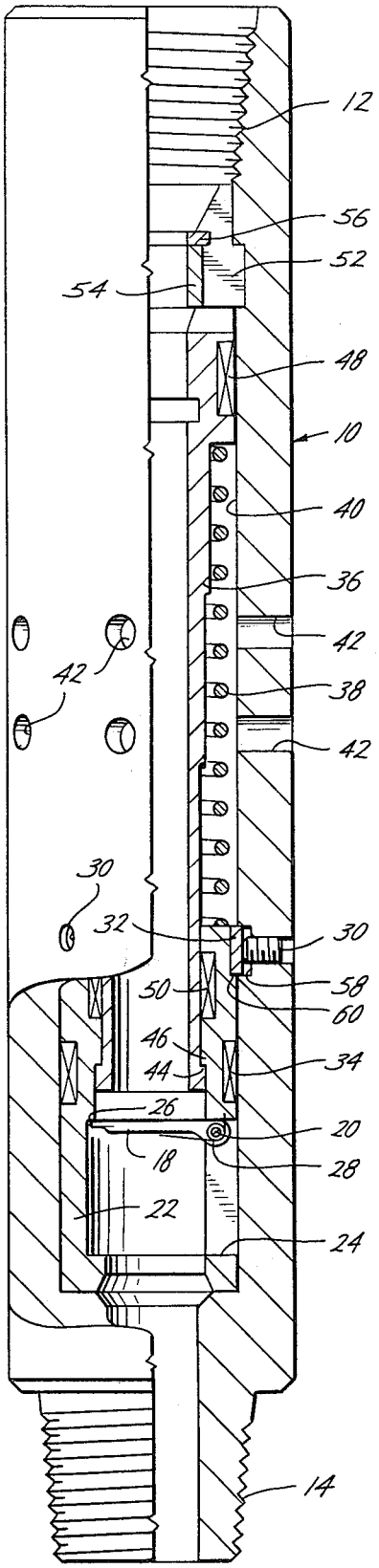
FIG. 1 is a plan view, partially in section, of the inside blowout preventer drilling tool showing, in particular, the piston in its upper or raised position and the flapper closed.
Figure 2:
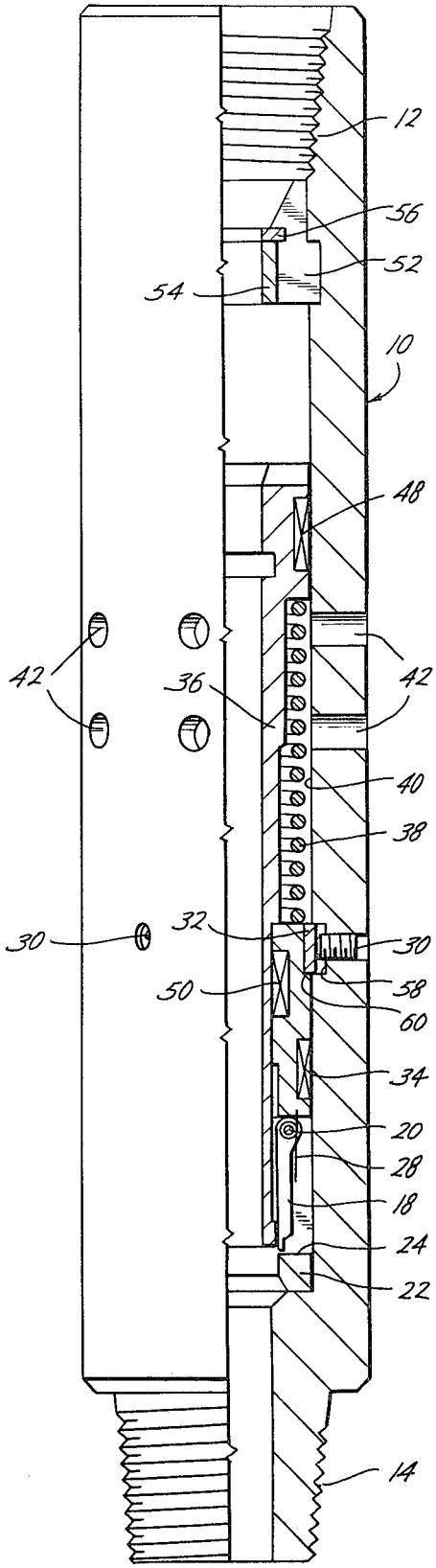
FIG. 2 is a view similar to that of FIG. 1 except that the piston is in its lower position encasing the flapper for maintaining the valve open.

First referring to FIGS. 1 and 2, the blowout preventer tool includes a tubular body or frame 10 which can be mounted between sections of drill string (not shown) through inner and outer threads 12, 14. A flapper element 18 is pivotally mounted through a pin 20 in a cage element 22 located in the lower portion of the frame 10. The cage 22 includes an opening or recessed portion 24 for receiving the flapper 18 in its lower-open position shown in FIG. 2. A shoulder 26 around the inner surface of the cage 22 forms a valve seat for the flapper 18 for closing the valve when the flapper 18 is in the upper-closed position shown in FIG. 1. A spring 28 is wound around the pin 20 and engages the flapper 18 as shown best in FIG. 1 for urging the flapper 18 towards the closed position shown in FIG. 1. The cage 22 is locked in place in the frame 10 by a plurality of retaining screws 30 which engage the cage 22 through a retaining ring 32, an appropriate seal 34 formed of rubber or other resilient material being provided between the inner surface of the frame 10 and the cage 22.

A piston 36 is mounted above the flapper 18 and operates to maintain the flapper 18 open as shown in FIG. 2 during normal well conditions in a manner which will be described in detail below. The piston 36 is movable between an upper position shown in FIG. 1 where the flapper valve 18 is closed and a lower position shown in FIG. 2 where the flapper 18 is open.

When the flapper 18 is open the piston 36 encases it and protects it from the abrasive drilling mud circulating through the drill string. When the piston 36 moves between its upper and lower positions it operates as a cam and moves the flapper 18 downwardly to the open position. A helical power spring 38, located in a chamber 40 formed between the piston 36 and the inner wall of the frame 10, normally urges the piston 36 upwardly toward the position shown in FIG. 1 where the flapper 18 is closed.

A plurality of openings or ports 42 communicate the chamber 40 with the annulus between the frame 10 and the wall of the well hole (not shown). Under normal operating conditions the greater fluid pressure in the drill string relative to the pressure outside the drill string will act on the piston and overcome the force of the upper spring 38, maintaining the piston 36 in the position shown in FIG. 2 encasing the flapper 18 for unrestricted flow through the valve. If fluid pressure in the well hole increases above a predetermined safe level, the loss of the pressure differential will cause the piston 36 to move upwardly out of engagement with the flapper 18 to the position where the flapper 18 will automatically move upwardly and close the valve. This condition is maintained until, for example, greater density drilling mud is circulated through the drill string to restore the normal pressure differential. As can be seen, when a greater pressure is applied from above, the flapper 18 will partially open when the spring load on it is overcome, the piston 36 moving to open and encase the flapper 18 when the internal pressure increases enough to overcome the force of the power spring 38.

Cooperating shoulders 44, 46, located on the outer surface of the piston 36 and inner surface of the cage 22 engage each other when the piston is in its uppermost position for limiting upward movement of the piston 36. Appropriate fluid-tight seals 48, 50, are respectively provided between the piston 36 and the frame 10 and cage 22.

The internal components of the valve can be formed as a cartridge which can easily be inserted through the upper end of the tubular body. The cartridge is held in position by a split retainer ring 52 which is prevented from falling out by a retainer ring 54 and a spiral retaining ring 56. The split retainer ring 52 also reacts against high loads exerted against the flapper 18.

It will also be noticed that a cavity 58 is formed in the inner surface of the tubular body for receiving the split retainer ring 32 so that the ring 32 will not interfere with the cartridge during installation. After the cartridge has been installed, the retainer screws 30 (preferably three of them) are turned uniformly to collapse the split retainer 32 to engage a shoulder 60 located on the outer surface of the cage for locking the cartridge in position and reacting any force from the flapper 18 when it is closed.

Figure 3:
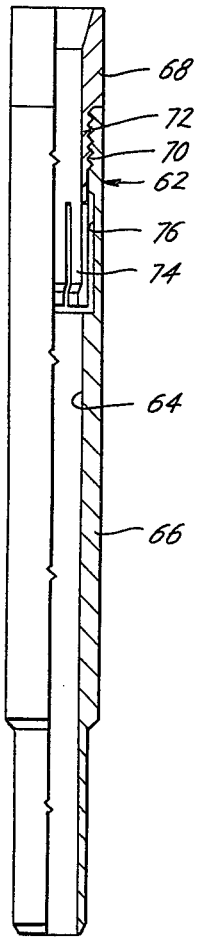
FIG. 3 is a plan view, partially in section, of a sleeve which can be used to maintain the valve open when the piston is in the position shown in FIG. 1.

A sleeve 62 is shown in FIG. 3 which can be used to maintain the flapper 18 open while the tool is installed. The sleeve 62 includes a bore 64 which permits tools to be lowered below the sleeve while the sleeve is in place. It is apparent that the flapper 18 will remain open until the sleeve 62 is removed. The sleeve 62 is held in place through frictional contact between the flapper 18 and the sleeve 62.

As shown in FIG. 3, the sleeve 62 is formed of two parts, a body portion 66 and a collett portion 68 which are joined together through cooperating threads 70, 72, respectively, and are secured to each other through appropriate set screws (not shown). The collett 68 includes a plurality of flexible fingers 74 located around its lower end, the fingers operating to expand into a recess 76 located in the inner wall of the body portion 66.

Figure 4:
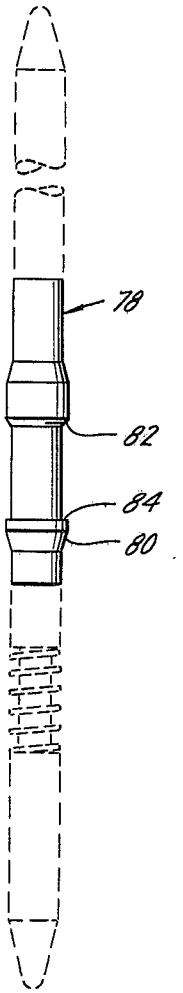
FIG. 4 is a plan view of a retrieval tool, for the sleeve of FIG. 3, the significant portion of which is shown in solid lines.

A sleeve retrieval tool 78 is shown in FIG. 4, the portion of which is most pertinent to the subject invention being shown by the solid lines. When the tool 78 is inserted downwardly through the sleeve 62, the tapered shoulders 80 and 82 engage the fingers 74, expanding them outwardly into the recess 76 so that the tool 78 can be moved downwardly through the sleeve 68. The tool 78 operates to retrieve and pull the sleeve back up through the drill string when a square shoulder 84 located above the tapered shoulder engages the lower ends of the fingers 74 causing the tool 78 and sleeve 68 to move upwardly as a single unit. The tool can be adapted to any downhole instrumentation survey tool or it can be used on a specially designed retrieving tool similar in shape as shown on FIG. 4.

Thus, a blowout preventer tool is provided with inner valve components which can be formed as cartridge and easily installed. The valve element is a flapper which is automatically closed responsive to an external pressure increase which eliminates the normal pressure differential. The use of a flapper for this function, as opposed to the ball valves heretofore used, provides a valve opening with a greater diameter for reducing the pressure drop through the valve and allows well servicing and instrumentation tools to be lowered through the blowout preventer when the flapper is closed. In addition, by using a flapper and piston configuration as described above, the flapper is protected from the abrasive influences of circulating drilling mud.

The foregoing disclosure and description of the invention are illustrative and explanatory thereof, and various changes in the size, shape and materials as well as in the details of the illustrated construction may be made without departing from the spirit of the invention.

We claim:

1. An inside blowout preventer well tool, comprising:

an elongated body threaded at both ends for securing in a conduit when desired and including an axial opening extending through said body;

a flapper pivotally mounted on a side of said axial opening movable between a lower-open position and an upper-closed position;

a downwardly-facing valve seat around the opening, the flapper engaging the seat in a flow sealing relationship in the upper-closed position for blocking fluid flow;

spring means for urging the flapper toward the seat, a piston movably disposed in said opening between an upper position where the lower end of the piston is above the valve seat and a lower position where the piston operably engages the flapper and holds it in the lower-open position;

urging means for normally urging the piston toward its upper position;

said piston being arranged pressure responsive in order that when the internal pressure of drilling mud normally circulating through the opening is greater by a predetermined amount than pressure outside the body the pressure differential will overcome the force of the urging means and move the piston to the lower position, said piston responsive to fluid pressure outside said body for moving said piston to its upper position when the pressure differential is reduced by a predetermined amount;

a hollow cage rigidly mounted in said axial opening, said flapper being pivotally mounted on said cage and the valve seat being formed around the inner surface of the cage.

an outer surface of the cage includes an upwardly-facing shoulder and the inner wall of the body includes a groove coextensive with the shoulder, and a retaining ring in the groove engaging the upper side of the groove and the shoulder for restraining upward movement of the cage, relative to the body; and the ring is split and the groove is at least as deep as the width of the ring so that at least a portion of the cage can be inserted below the groove without contacting the ring, a plurality of set screws moving the ring inwardly against the cage to engage the shoulder.

2. An inside blowout preventer well tool, comprising:

an elongated body threaded at both ends for securing in a conduit when desired and including an axial opening extending through said body;

a flapper pivotally mounted on a side of said axial opening movable between a lower-open position and an upper-closed position;

a downwardly-facing valve seat around the opening, the flapper engaging the seat in a flow sealing relationship in the upper-closed position for blocking fluid flow;

spring means for urging the flapper toward the seat, a piston movably disposed in said opening between an upper position where the lower end of the piston is above the valve seat and a lower position where the piston operably engages the flapper and holds it in the lower-open position;

urging means for normally urging the piston toward its upper position;

said piston being arranged pressure responsive in order that when the internal pressure of drilling mud normally circulating through the opening is greater by a predetermined amount than pressure outside the body the pressure differential will overcome the force of the urging means and move the piston to the lower position, said piston responsive to fluid pressure outside said body for moving said piston to its upper position when the pressure differential is reduced by a predetermined amount;

a hollow cage rigidly mounted in said axial opening, said flapper being pivotally mounted on said cage and the valve seat being formed around the inner surface of the cage; and the piston and cage include cooperating shoulders which enage each other when the piston reaches the upper position for limiting upper movement of the piston.

3. An inside blowout preventer well tool, comprising:

an elongated body threaded at both ends for securing in a conduit when desired and including an axial opening extending through said body;

a flapper pivotally mounted on a side of said axial opening movable between a lower-open position and an upper-closed position;

a downwardly-facing valve seat around the opening, the flapper engaging the seat in a flow sealing relationship in the upper-closed position for blocking fluid flow;

spring means for urging the flapper toward the seat, a piston movably disposed in said opening between an upper position where the lower end of the piston is above the valve seat and a lower position where the piston operably engages the flapper and holds it in the lower-open position;

urging means for normally urging the piston toward its upper position;

said piston being arranged pressure responsive in order that when the internal pressure of drilling mud normally circulating through the opening is greater by a predetermined amount than pressure outside the body the pressure differential will overcome the force of the urging means and move the piston to the lower position, said piston responsive to fluid pressure outside said body for moving said piston to its upper position when the pressure differential is reduced by a predetermined amount;

a hollow cage rigidly mounted in said axial opening, said flapper being pivotally mounted on said cage and the valve seat being formed around the inner surface of the cage.

said urging means includes a helical spring;

a chamber is formed above the cage and between the outer wall of the piston and the passage wall, seal means for providing a fluid-tight seal between the chamber and rest of said opening, the helical spring being mounted in the chamber; and the cage, piston and helical spring are assembled as a cartridge prior to insertion into the body, an upper-facing shoulder in the lower portion of said opening for engaging the lower end of the cage and restraining ring means in the upper portion of the opening for engaging the piston when it reaches the upper position.

4. An inside blowout preventer well tool, comprising:

an elongated body threaded at both ends for securing in a conduit when desired and including an axial opening extending through said body;

a flapper pivotally mounted on a side of said axial opening movable between a lower-open position and an upper-closed position;

a downwardly-facing valve seat around the opening, the flapper engaging the seat in a flow sealing relationship in the upper-closed position for blocking fluid flow;

spring means for urging the flapper toward the seat, a piston movably disposed in said opening between an upper position where the lower end of the piston is above the valve seat and a lower position where the piston operably engages the flapper and holds it in the lower-open position;

urging means for normally urging the piston toward its upper position;

said piston being arranged pressure responsive in order that when the internal pressure of drilling mud normally circulating through the opening is greater by a predetermined amount than pressure outside the body the pressure differential will overcome the force of the urging means and move the piston to the lower position, said piston responsive to fluid pressure outside said body for moving said piston to its upper position when the pressure differential is reduced by a predetermined amount;

a sleeve is insertable through the valve seat when the piston is in its upper position for maintaining the flapper open regardless of the differential between the outside and inside pressures; and a plurality of flexible fingers project downwardly from the inner surface of the sleeve so that a tapered shoulder can move down through the sleeve but an upwardly-facing square shoulder can engage the fingers and pull the sleeve out of the body.

* * * * *